US008544558B1

(12) United States Patent
Seal

(10) Patent No.: US 8,544,558 B1
(45) Date of Patent: Oct. 1, 2013

(54) TONGUE PULLED SPREADER AND GRADER SYSTEM

(75) Inventor: Richard A. Seal, Picayune, MS (US)

(73) Assignee: Domor Equipment, LLC, Eureka, IL (US)

( * ) Notice: Subject to any disclaimer, the term of this patent is extended or adjusted under 35 U.S.C. 154(b) by 74 days.

(21) Appl. No.: 12/948,963

(22) Filed: Nov. 18, 2010

Related U.S. Application Data

(60) Provisional application No. 61/403,878, filed on Sep. 23, 2010.

(51) Int. Cl.
*E02F 3/76* (2006.01)

(52) U.S. Cl.
USPC ..... 172/799.5; 172/72

(58) Field of Classification Search
USPC ..... 172/799.5, 684.5, 787, 72, 197
See application file for complete search history.

(56) References Cited

U.S. PATENT DOCUMENTS

| | | | | |
|---|---|---|---|---|
| 1,232,314 | A | 7/1917 | Hubbard | |
| 3,430,366 | A * | 3/1969 | King | 37/428 |
| 4,140,425 | A * | 2/1979 | Flippin | 405/181 |
| 4,217,962 | A * | 8/1980 | Schaefer | 172/197 |
| 4,260,290 | A * | 4/1981 | Flippin | 405/181 |
| 4,320,988 | A | 3/1982 | Seal | |
| 4,373,591 | A * | 2/1983 | Schaaf et al. | 172/328 |
| 4,490,929 | A * | 1/1985 | Lucas | 37/381 |
| 4,568,219 | A * | 2/1986 | Berry | 404/118 |
| 4,630,686 | A | 12/1986 | Ausmus, Jr. | |
| 4,655,297 | A | 4/1987 | Bourgeois | |
| 4,700,786 | A * | 10/1987 | Berry | 172/799.5 |
| 4,898,247 | A * | 2/1990 | Springfield | 172/799.5 |
| 4,917,533 | A | 4/1990 | Wilson | |
| 4,930,582 | A * | 6/1990 | Goss | 172/788 |
| 4,976,052 | A * | 12/1990 | Jeane | 37/381 |
| 5,191,943 | A | 3/1993 | Minor et al. | |
| 5,213,164 | A * | 5/1993 | Mork | 172/445.1 |
| 5,289,880 | A * | 3/1994 | Barto | 172/799.5 |
| 5,511,625 | A * | 4/1996 | Mork | 172/445.1 |
| 5,890,546 | A * | 4/1999 | Kerpash, Sr. | 172/684.5 |
| 6,032,746 | A * | 3/2000 | Lowery | 172/445.1 |
| 6,206,106 | B1 * | 3/2001 | Heckendorf | 172/799.5 |
| 6,347,670 | B1 * | 2/2002 | Miskin | 172/199 |
| 6,615,929 | B2 * | 9/2003 | Heckendorf | 172/799.5 |
| 6,904,979 | B1 * | 6/2005 | Confoey | 172/799.5 |
| 7,063,166 | B1 * | 6/2006 | Grosberg | 172/200 |
| 7,325,636 | B2 * | 2/2008 | Yeoman et al. | 180/62 |
| 7,600,576 | B2 * | 10/2009 | Gayer | 172/799.5 |
| 7,712,559 | B2 * | 5/2010 | Yeoman et al. | 180/62 |
| 7,849,932 | B2 * | 12/2010 | Friggstad et al. | 172/278 |
| 7,980,282 | B2 * | 7/2011 | Moyna et al. | 152/305 |
| 7,980,319 | B2 * | 7/2011 | Maeda | 172/789 |

* cited by examiner

*Primary Examiner* — Árpád Fábián-Kovács
(74) *Attorney, Agent, or Firm* — Garvey, Smith, Nehrbass & North, L.L.C.; Gregory C. Smith; Julia M. FitzPatrick

(57) ABSTRACT

A tongue pulled spreader and grader system having a pair of spaced apart sidewalls and cross beams to define a frame portion, a plurality of moveable or fixed blades extending between the sidewalls, each blade positionable along the length of each sidewall and fixed in position at a predetermined angle; a tongue for mounting the frame to the rear of a vehicle; a pair of wheels positioned on an axle on either side of the sidewalls; means for manually or hydraulically extending the wheels to a down position to make contact with a surface in order to transport the spreader and grader and for retracting the wheels to an up position so that the spreader and grader can undertake the grading process. The spreader and grader can attach to and be operated by ATVs, SUVs, light trucks, lawn tractors, sub compact tractors, side by side ATVs and fork trucks.

13 Claims, 7 Drawing Sheets

TONGUE PULLED SPREADER AND GRADER SYSTEM

CROSS-REFERENCE TO RELATED APPLICATIONS

This application claims priority from provisional patent application filed on Sep. 23, 2010, bearing Ser. No. 61/403,878, by the same inventor, incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to graders. More particularly, the present invention relates to a tongue pulled/improved spreader/grader of the type pulled by a ATV, Lawn Tractor, or other motorized vehicle having a Tongue system that connects to the desired vehicle to pull it. The tongue system has an adjustment system to control the grader's pitch. The means of adjustment can be manually, mechanically or hydraulically. The tongue pulled spreader grader contains an axle and tire system that can be used to raise and lower the grader. The axle and wheel system can be raised and lowered manually, mechanically, or hydraulically.

2. General Background of the Invention

There are many types of spreader/graders in the industry which are pulled usually by a vehicle, such as a truck or tractor equipped to pull the grader along the ground. However, there is a need in the industry to provide a tongue pulled spreader/grader which can attach to and be operated by ATVs, SUVs, light trucks, lawn tractors, sub compact tractors, side by side ATVs and but not limited to fork trucks. Such a spreader/grader would be very beneficial to be able to be pulled by such a variety of vehicles. Also, rather than the spreader/grader having to be hauled on the back of a flat bed truck or the like, it would be even more beneficial to provide a spreader/grader which would have the capability to be converted from a spreader/grader for grading to a spreader/grader which would have a system of wheels which could be maneuvered upward and downward, so that in the up position the spreader/grader is set to grade, but in the down position, the wheels would rest on the ground, with the grader raised above the ground, and the grader could be pulled to various locations without the need to place the grader on another vehicle, but pulled by the same vehicle which pulled the spreader/grader while it was grading.

BRIEF SUMMARY OF THE INVENTION

The apparatus of the present invention is designed to be pulled and or be use by any vehicle having a means to tow a spreader/grader but the vehicle does not have means to connect to and operate a conventional spreader/grader, such as an 3-point hitch with hydraulic lift systems built into it such as ones found on farm tractors. The tongue pulled spreader/grader can attach to and be operated by ATVs, SUVs, light trucks, lawn tractors, sub compact tractors, side by side ATVs and but not limited to fork trucks.

What is provided is an improved spreader/grader system having a pair of spaced apart sidewalls and cross beams to define a frame portion, a plurality of moveable or fixed blades extending between the sidewalls, each of the blades positionable along the length of each sidewall and fixed in a position at a predetermined angle; a means for mounting the frame to the rear of a vehicle, of the type discussed above; a pair of wheels positioned on an axle on either side of the sidewalls; means for manually or hydraulically extending the wheels to a down position to make contact with a surface in order to transport the spreader/grader and for retracting the wheels to an up position so that the spreader/grader can be used to undertake the grading process.

Therefore, it is a principal object of the present invention to provide a tongue pulled spreader/grader which can attach to and be operated by ATVs, SUVs, light trucks lawn tractors, subcompact tractors, side by side ATVs, and which has the capability to be transported on a pair of wheels mechanically or hydraulically moveable from a first down position wherein the wheels make contact with the ground during transport, to an up position where the wheels are away from the ground, and the spreader/grader blades contact the ground to undertake the spreading and grading process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
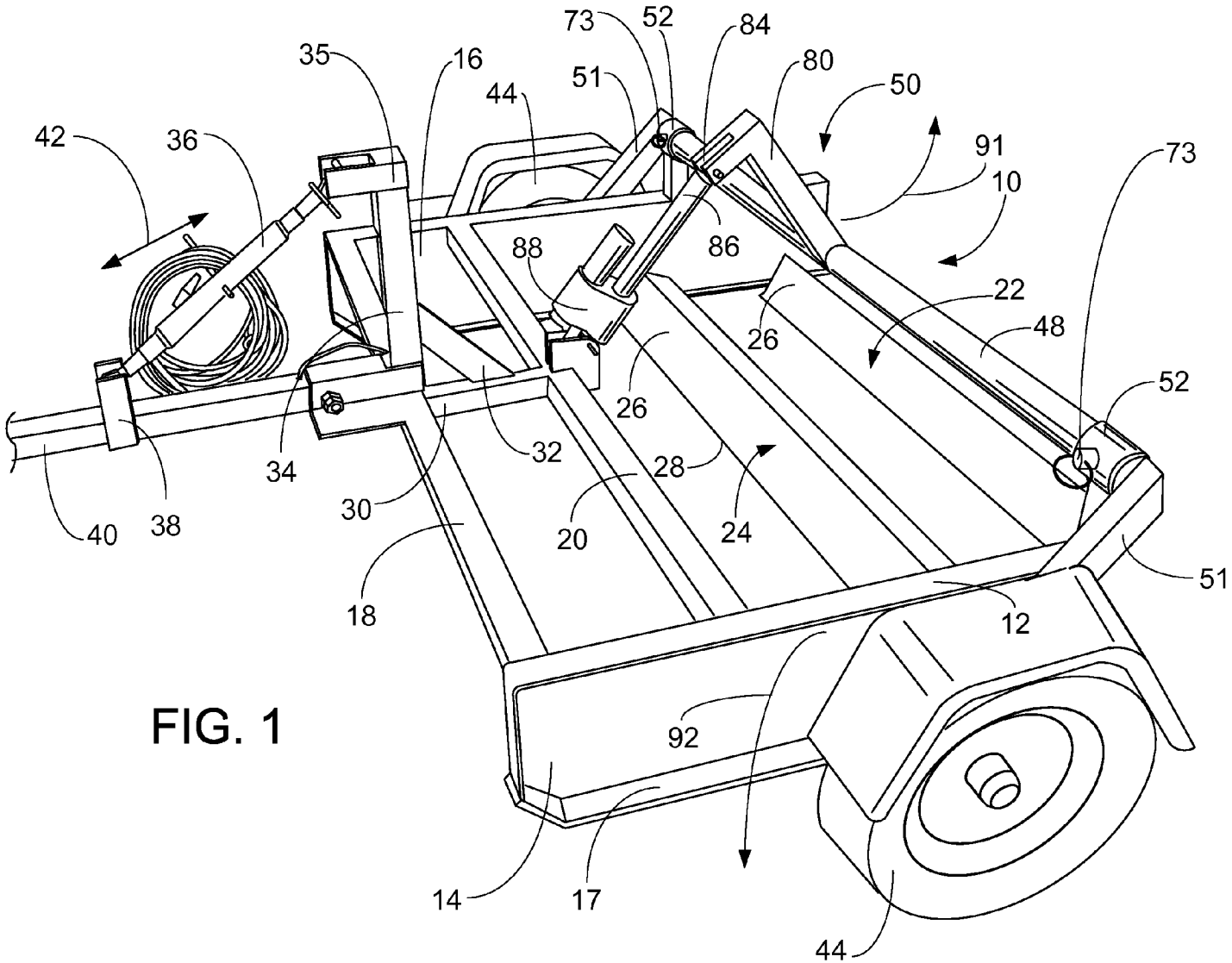
FIG. 1 illustrates an overall view of the preferred embodiment of the tongue pulled spreader/grader of the present invention utilizing mechanical means to move the wheel assembly.
Figure 2:
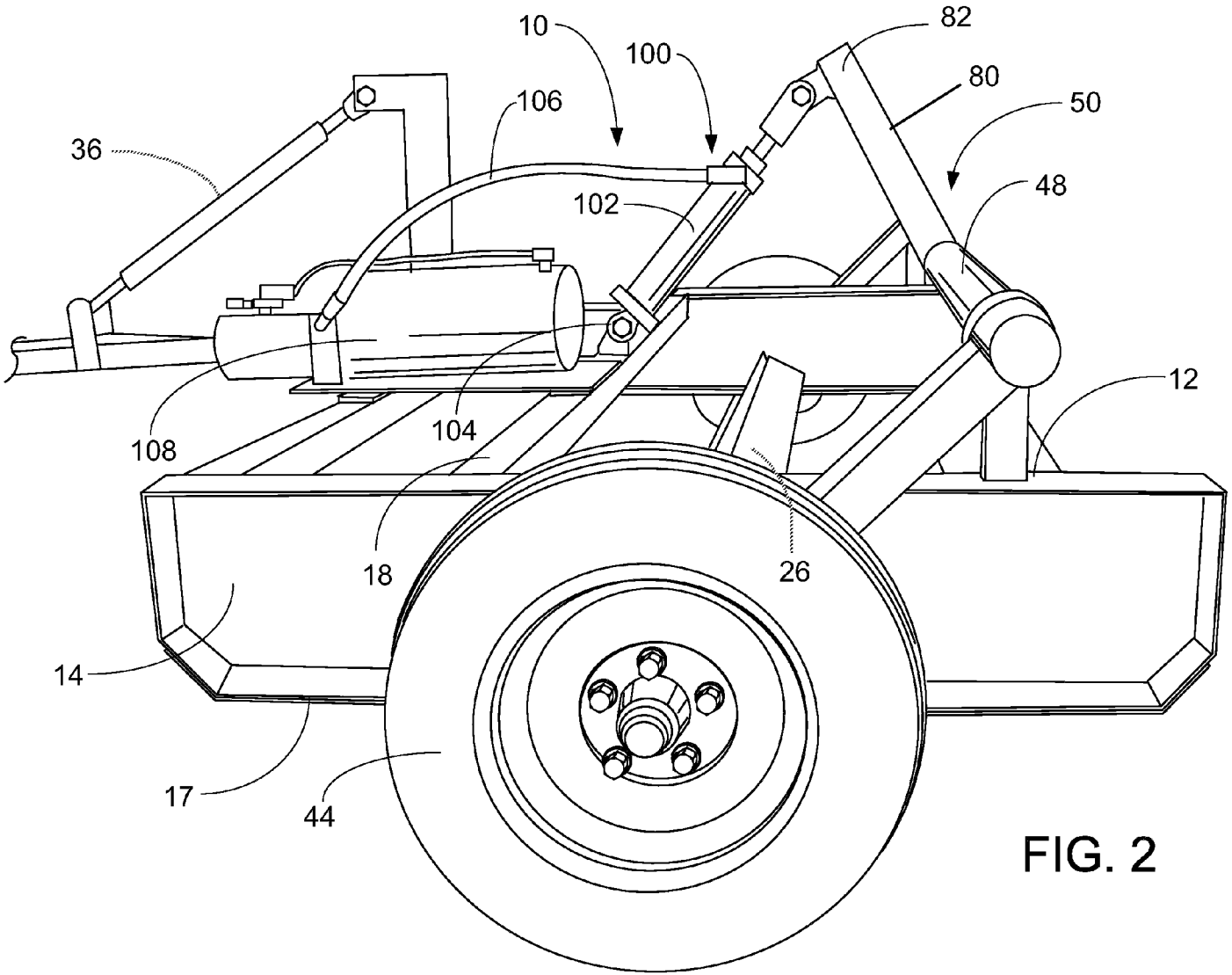
FIG. 2 illustrates a side view of the preferred embodiment of the tongue pulled spreader/grader of the present invention utilizing hydraulic tower to move the wheel assembly.
Figure 3:
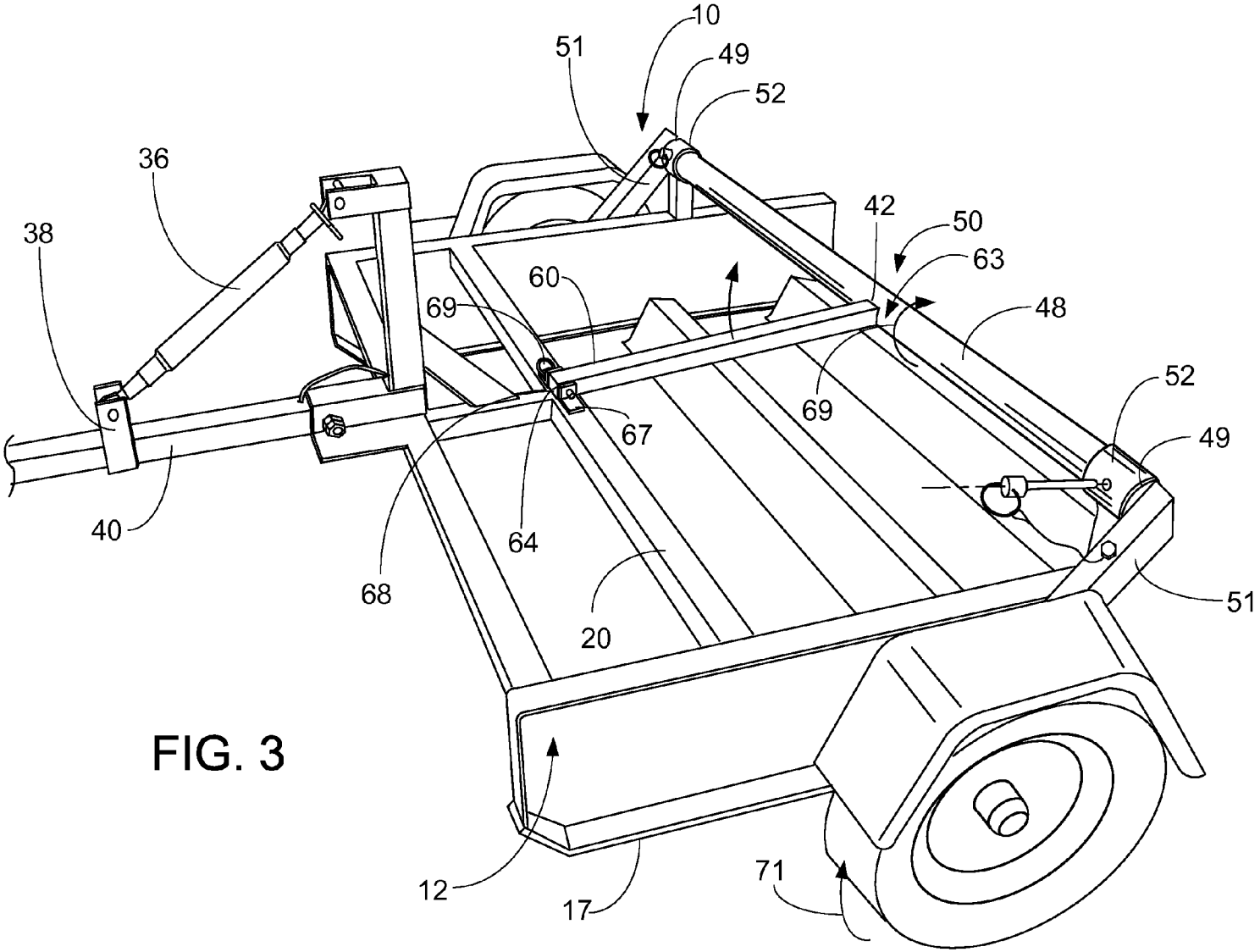
FIG. 3 illustrates an overall view of the wheel lifting mechanism in the preferred embodiment of the tongue pulled spreader/grader of the present invention utilizing manual power to move the wheel assembly.

Without departing from the principle of the invention, and without limitation to other embodiments differing in size, scope of the spreader/grader, and prior to a discussion of the FIGS. 1 through 10, an exemplary embodiment of the present invention will be described by way of example only. It should be noted that the present invention provides a spreader grader which has a means for adjusting the pitch of the spreader/grader and a means for moving a wheel assembly, as will be discussed and defined further, between up and down positions. FIG. 1 illustrates the first means, which is a mechanical means, as set forth below; FIG. 2, and other figures illustrate the second means, which is the hydraulically powered means, and FIG. 3 illustrates the manual means for moving the wheel assembly 50. These will be discussed below.

FIGS. 1 through 10 illustrate the preferred embodiment of the improved spreader/grader system 10 of the present invention, sometimes referred to as the system 10.

As seen in overall view in FIG. 1, the spreader/grader system 10 overall comprises a generally rectangular metal frame 12, having a pair of sidewalls 14, 16, with the sidewalls 14, 16 spaced apart by a first forward cross member 18, a rear cross member 20. There is further provided at least two blade assemblies 22, 24, each assembly 22, 24 having a cutting blade 26 mounted thereon along substantially the entire length of each assembly 22, 24, and having a spreading/cutting edge 28 for undertaking the spreading and grading process when the system 10 is in use. The bottom surface of each sidewall 14, 16 has mounted thereon replaceable wear shoes 17, which are dragged along the ground being graded, and can be replaced when worn.

There is further provided a member 30 positioned along the midpoint of and secured between the forward cross member 18 and rear cross member 20. Member 30 supports a brace 32 which is supporting an upright brace 34. The upper end 35 of brace 34 engages the first end of adjustable bar member 36, while the second end of adjustable bar member 36 is secured to a bracket 38 positioned on the tongue 40 of the system 10. Tongue 40 would be a typical tongue known in the industry which would have a distal end (not illustrated) which connects to a vehicle which could transport or pull spreader/grader 10, such as, but not limited to an ATV, SUV, light truck, lawn tractor, subcompact tractor, side by side ATV, or any other vehicle to which the end of tongue 40 could be secured. The second end of the tongue 40 is secured to the frame 10 at bracket 41, with nut/bold assembly 43. This is seen in greater detail in isolated view in FIG. 6. The adjustable bar member 36 would be utilized to change the pitch of the grader and the cutting depth of the cutting blades 26 during use, by extending or retracting the length of the adjustable bar 36 in the direction of arrows 42. The adjustability of the bar 36 in may be done mechanically, manually, or hydraulically, depending on the choice of the operator of the system 10.

Turning now to the movement of the wheel assembly 50 of the present invention, reference is made to FIG. 1 where the movement is done mechanically. For future reference, wheel assembly 50 is defined as the pair of wheels 44 secured to the ends of axle 48, which is mounted to each wheel 44 via the brace 51 secured between the axle 48 and each wheel 44, so that when the axle 48 is rotated on bushings 52, the wheels 44 are likewise rotated. This relationship is seen in isolated views in FIG. 7.

FIG. 1 illustrates a pair of wheels 44, mounted on an axle 48, the wheels 44 positioned on the outer face of each sidewalls 14, 16, which would describe the wheel assembly 50. The positioning of the wheels 44 as part of assembly 50 will be discussed in detail below. As seen in FIG. 1, wheel assembly 50, as defined earlier, would include a brace 80 mounted at the midpoint of axle 48, terminating in an upper end 82, wherein a bracket 84 engages the upper end of an arm 86 which extends from a motor 88. When the motor 88 is powered by, for example, electric tower through electrical line 89, the arm 86 extends outward in the direction of arrow 91, and in doing so forces the brace 80 upward which imparts rotation of axle 48 in bushings 52, which in turn rotates wheels 44 upward and no longer contacting the ground 46. Likewise, when the motor 88 would be reversed, the arm 86 would retract, rotating the axle in the opposite direction, thus moving the wheels 44 down in the direction of arrow 92, and the wheels 44 in the down position would rest on the ground 46.

Before a discussion had regarding the movement of the wheels 44 between the up and down positions through hydraulic means, which is the preferred means, reference is made to FIG. 3 which illustrates the embodiment of the system 10 wherein the wheels are moved from the up and down positions manually. As seen in FIG. 3, there is provided an axle 48 which extends above the frame 12, and each end 49 of the axle 48 extending beyond each sidewall 14, 16. There is provided a brace 51 extending from the end 49 of the axle 48, the brace 51 having a second end engaging a spindle 53 on each wheel 44, as seen in detail view in FIG. 7. The axle 48 also includes a bushing 52 adjacent each end, as seen in FIG. 3. As part of the wheel lifting assembly 50, there is a center brace 60 having a first end 62 connected to the center point 63 of the axle 48, and a second end 64 pivotally mounted to a bracket 67 at the center point 68 of the rear cross member 20. As illustrated the second end 64 is secured to the bracket 67 via a cotter pin 69, which allows the center brace 60 to pivot.

Figure 5:
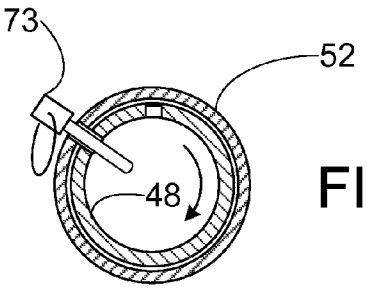
FIGS. 4 and 5 illustrate cross-section views of the locking mechanism maintaining the wheels in the raised or lowered position during use of transport of the spreader/grader.
Figure 4:
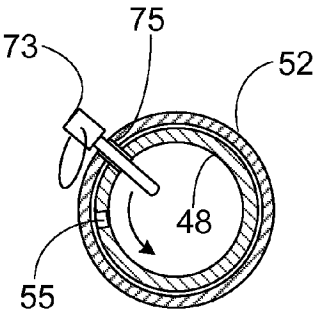
Figure 7:
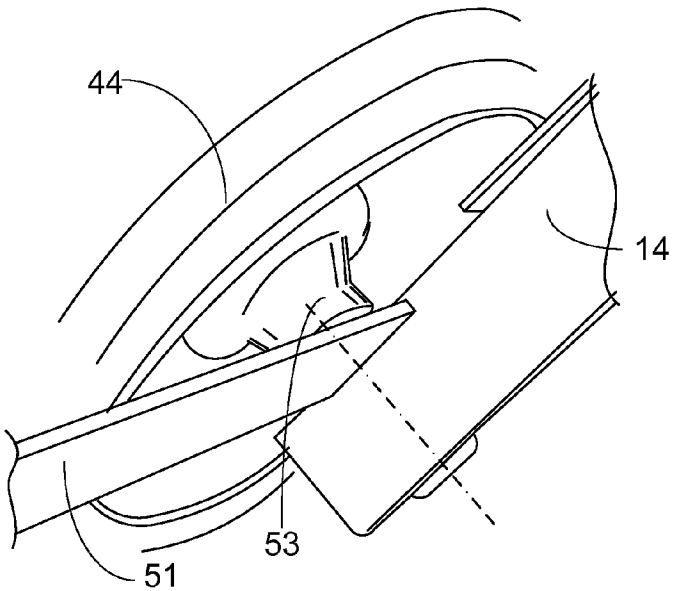
FIG. 7 illustrates an isolated view of the attachment between the wheels and the brace of the wheel assembly in the spreader/grader of the present invention.
Figure 6:
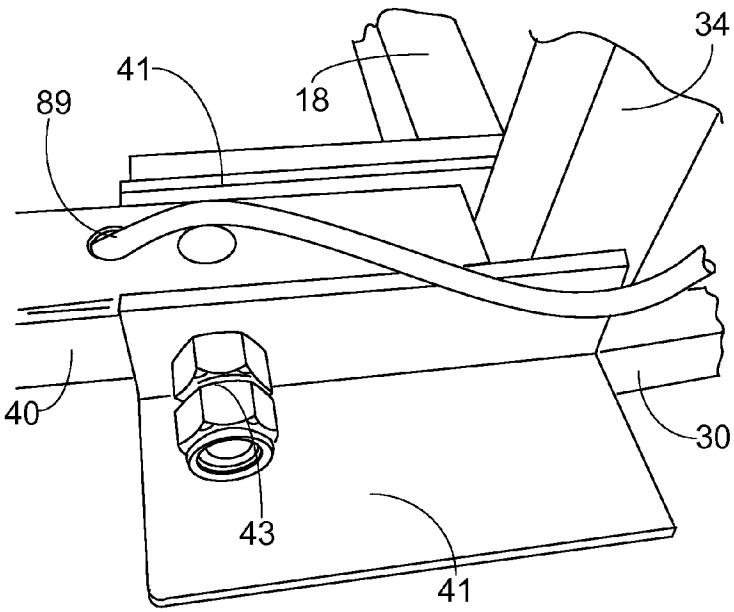
FIG. 6 illustrates an isolated view of the hydraulic line providing hydraulic fluid to the hydraulic cylinder which raises and lowers the wheels between up and down positions.

In operation, as seen in FIG. 3, and in isolated views in FIGS. 4 and 5, the wheels 44 are locked in the down position via a pin 73 inserted into an opening 75 in each bushing 52 and further into an opening 55 in the wall of the axle 48. When one wishes to raise the wheels 44 manually, the pins 73 are removed, then the axle 48 can rotated in the direction of arrows 69, and the wheels 44 are rotated within bushings 52 upward in the direction of arrows 71, and would no longer make contact with the ground. In order to secure the wheels 44 in place in the up position, pins 73 at each end are inserted through a second opening 75 in each bushing 52, and further into an opening 55 in the wall of axle 48, so as to lock the wheels 44 in place while the pins 73 are in place. When the pins 73 are removed, the wheels can be lowered back into the position as seen in FIG. 3, and the pins 73 are re-inserted into the opening which will lock the wheels 44 in the down position.

Figure 8:
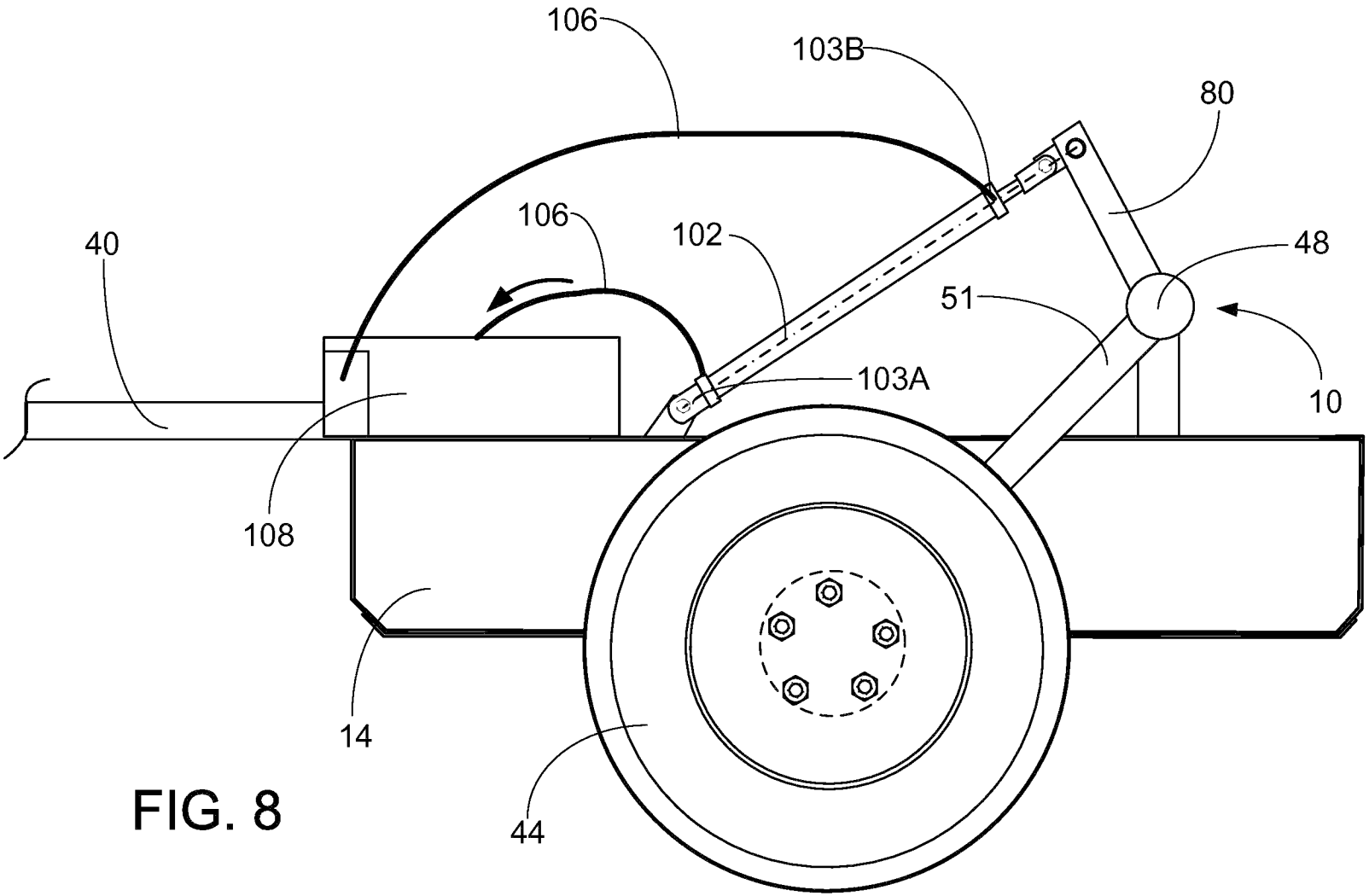
FIG. 8 illustrates a side view of the hydraulic powered assembly for hydraulically lifting or lowering the wheels in the spreader/grader of the present invention.
Figure 9:
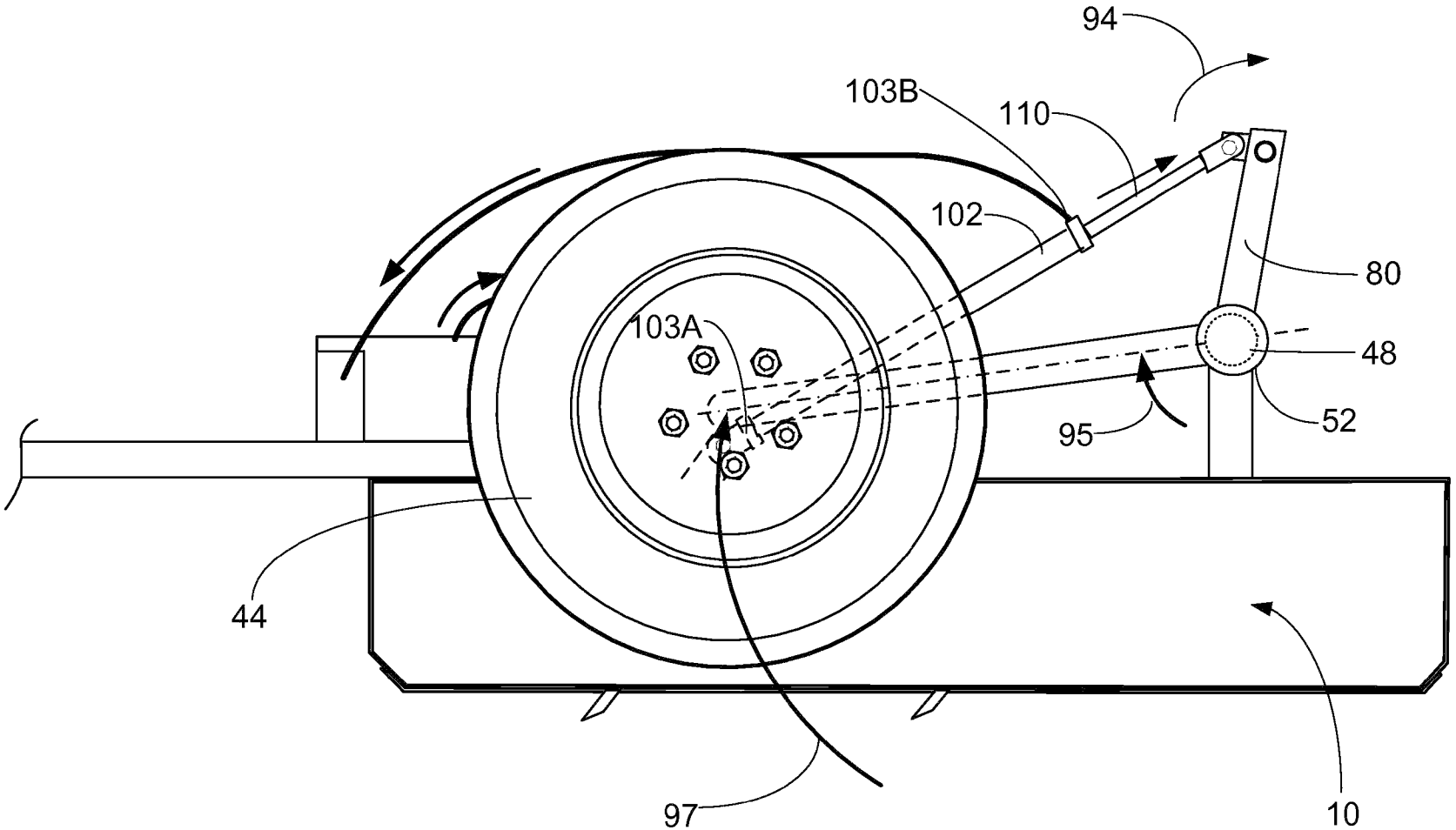
FIG. 9 illustrates a side view of the tires moved to the up position from the down position as seen in FIG. 8.

Reference is now made to FIG. 2, and FIGS. 8 through 10 which will be used to discuss the important feature of the spreader/grader system for allowing the wheels 44 to be moved hydraulically by the operator. As seen in FIG. 2, the wheels 44 are in a first down position, where wheels 44 are making contact with the ground 46. Whereas, as seen in FIG. 9, the wheels 44 have been retracted to the second up position, where the wheels 44 make no contact with the ground 46. In this position the spreader/grader frame 12 is resting on the ground 46, with the cutting blades 26 in position to spread or grade along the surface of the ground 46, when the spreader/grader 10 is pulled along the surface.

Continuing with FIG. 2 and FIGS. 8 through 10, these figures depict the same movement of the wheel assembly 50, as described in FIGS. 1 and 3, except that the wheel assembly 50 is being moved between up and down positions via a hydraulic means 100. This means 100 comprises a hydraulic cylinder 102 positioned between the upper end 82 of brace 80, mounted on axle 48. The second end of hydraulic cylinder 102 would be secured to a bracket 104 on cross member 18. As seen, there is provided a line 106 for transporting hydraulic fluid from a hydraulic pump 108, mounted on the frame 12 to the hydraulic cylinder 102. Pump 108 would obtain its fluid from a hydraulic tank (not illustrated) mounted on the vehicle pulling the system 10.

Figure 10:
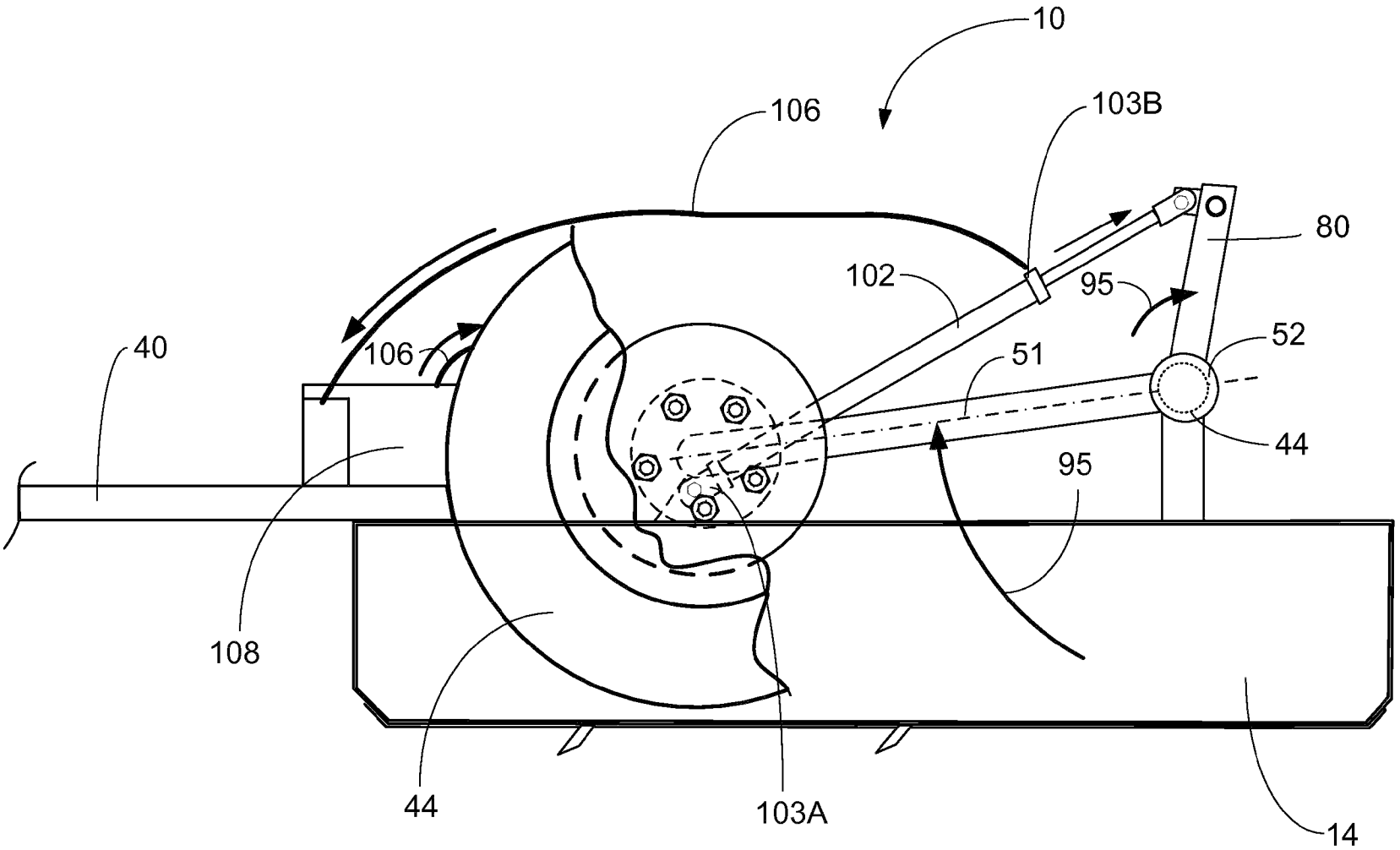
FIG. 10 illustrates the tires locked into the up position while the spreader/grader is undertaking a grading task.

During operation, FIG. 8 illustrates the system 10, with the hydraulic cylinder 102 receiving fluid on both ends 103A and 103B, via lines 106 from pump 108, with the wheels 44 in the down position. In FIGS. 9 and 10, when fluid is pumped into a first end 103A, the rod 110 within the cylinder 102 is pushed out by the fluid, and when this occurs, brace 80 is moved back in the direction of arrow 94; which rotates brace 51 in the direction of arrow 95, which raises the wheels 44 upward as seen in FIGS. 9 and 10, and which allows cutting blades 26 to engage the surface 46 to start the grading process. Likewise, when grading is complete, and the system 10 needs to be transported to another site, hydraulic fluid is pumped into end 103B, which forces the rod 110 back into the cylinder 102, which in turns moves the brace 80 forward and rotates the wheels downward to re-engage the surface 46 for transport.

In each of the embodiments as discussed above, it is foreseen that the tongue-pulled grader may have other features, such as a plurality of blades set in both parallel and non-parallel positions between sidewalls 12, 14 of the spreader/grader 10. Also, it may be that the blades of the spreader/grader 10 may not be fixed in place by welding, but may be bolted in place so that the blades 26 can be re-positioned for certain tasks. Further, it may be that one or more of the blades may be moved hydraulically by the operator, so that manual positioning of the blades is avoided, but can be done by the operator while seated on the transport vehicle.

The following is a list of parts and materials suitable for use in the present invention.

PARTS LIST

Parts Number Description
10 system
12 metal frame
14, 16 side walls
17 replaceable wear shoes
18 forward cross member
20 rear cross member
22, 24 blade assemblies
26 cutting blade
28 cutting edge
30 member
32 brace
34 brace
35 upper end
36 adjustable bar member
38 bracket
40 tongue
41 bracket
43 nut/bolt assembly
42 arrow
44 wheels
46 ground/surface
48 axle
49 end
50 wheel assembly
51 brace
52 bushings
53 spindle
55 opening
60 center brace
62 first end
63 center point
64 second end
67 bracket
68 center point
69 cotter pin
71 arrow
73 pin
75 opening
80 brace
82 upper end
84 bracket
86 arm
88 motor
89 electrical line
91 arrow
94 arrow
95 arrow
100 hydraulic means
102 hydraulic cylinder
103A, 103B hydraulic cylinder ends
106 lines
108 pump
110 rod All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A tongue-pulled spreader and grader system, comprising:

a. a frame, having a pair of spaced apart sidewalls;

b. at least one blade positioned between the sidewalls for making contact to a surface to be graded;

c. an axle spanning across and positioned above the sidewalls;

d. a brace mounted on each end of the axle at a first end and secured to a rotatable wheel at a second end of each brace;

e. a mounting member extending between the midpoint of the axle at a first end and a hydraulic cylinder at a second end;

f. said hydraulic cylinder mounted to the mounting member at a first end of the hydraulic cylinder and mounted to the frame at a second end, for receiving hydraulic fluid to expand and retract the cylinder for moving the mounting member back for imparting rotation to the axle and movement to the braces attached to the wheels to raise and lower the wheels from a first position resting on the surface to a second position off the surface and above the level of the blade to allow the blade to cut into the surface as the frame is pulled along the surface;

g. the hydraulic cylinder further imparting rotation of the axle in the opposite direction to move the wheels from the second position above the blade to return to the first position resting on the surface; and h. a mountable container for containing said hydraulic fluid.

2. The spreader and grader system in claim 1, further comprising a tongue component in order to attach to and be operated by ATVs, SUVs, light trucks, lawn tractors, sub compact tractors, side by side ATVs.

3. The spreader and grader system in claim 1, wherein there are multiple cutting blades that may be fixed in place or moveable in various parallel or non-parallel positions to undertake the grading process.

4. The spreader and grader system in claim 1, wherein there are replaceable wear shoes attached the sidewalls.

5. The tongue-pulled spreader and grader system of claim 1 wherein the mountable container is mountable to any vehicle having a means to connect to the spreader and grader system or mountable to the grader itself.

6. A tongue-pulled spreader and grader system, comprising:

a. a frame, having a pair of spaced apart sidewalls;

b. at least a pair of blades positioned between the sidewalls for making contact to a surface, such as the ground, to be graded;

c. an axle spanning across and positioned above the sidewalls;

d. a brace mounted on each end of the axle at a first end and secured to a rotatable wheel at a second end of each brace;

e. a mounting member extending from the midpoint of the axle at a first end and a hydraulic cylinder at a second end;

f. said hydraulic cylinder connected to said mounting member at a first end of the hydraulic cylinder and mounted to the frame at a second end, for receiving hydraulic fluid to expand and retract the cylinder for moving the mounting member back, for imparting rotation to the axle and movement to the braces attached to the wheels, to raise and lower the wheels from a first position resting on the surface to a second position off the surface and above the level of the blades to allow the blades to cut into the surface as the frame is pulled along the surface;

g. the hydraulic cylinder further imparting rotation of the axle in the opposite direction to move the wheels from the second position above the blades to return to the first position resting on the surface;

h. a tongue component wherein a first end of the tongue component is attached to a back end of the frame and wherein a second end of the tongue component is configured to attach to a motorized vehicle; and i. an adjustable means extending between the tongue component and frame, and wherein the adjustable means is configured to change the pitch of the grader and the depth of the blades; and j. a mountable container for containing said hydraulic fluid wherein the mountable container is mountable to any vehicle having a means to connect to the spreader and grader system.

7. The spreader and grader system in claim 6, wherein the tongue component can be attached to ATVs, SUVs, light trucks, lawn tractors, sub compact tractors, and side by side ATVs.

8. The spreader and grader system in claim 6, wherein the adjustable means can be operated by hydraulic means.

9. The spreader and grader system in claim 6, wherein the adjustable means can be operated by manual means.

10. The spreader and grader system in claim 6, wherein the adjustable means can be operated by mechanical means.

11. The spreader and grader system in claim 6, wherein there are replaceable wear shoes attached to the sidewalls.

12. The spreader and grader system in claim 6, wherein the blades may be fixed in place or moveable in parallel or non-parallel positions to undertake the grading process.

13. A tongue-pulled spreader and grader system, comprising:

a. a frame, having a pair of spaced apart sidewalls;

b. at least a pair of blades positioned between the sidewalls for making contact to a surface to be graded, wherein said blades may be fixed in place or moveable in parallel or non-parallel positions to undertake the grading process;

c. an axle spanning across and positioned above the sidewalls;

d. a brace mounted on each end of the axle at a first end and secured to a rotatable wheel at a second end of each brace;

e. a mounting member extending from the midpoint of the axle at a first end and a hydraulic cylinder at a second end;

f. a hydraulic cylinder connected to the axle at a first end and mounted to the frame at a second end, for receiving hydraulic fluid to expand and retract the cylinder for imparting rotation to the axle to raise and lower the wheels from a first position resting on the surface to a second position above the level of the blades to allow the blades to cut into the surface as the frame is pulled along the surface;

g. the hydraulic cylinder further imparting rotation of the axle in the opposite direction to move the wheels from the second position above the blades to return to the first position resting on the surface;

h. a tongue component wherein a first end of the tongue component is attached to a back end of the frame and wherein a second end of the tongue component is configured to attach to any vehicle having a means to tow a spreader or grader;

i. an adjustable means extending between the tongue member and frame, and wherein the adjustable means is configured to change the pitch of the grader and the depth of the blades; and j. a mountable tank for holding said hydraulic fluid wherein the mountable tank is mountable to any vehicle having a means to connect to the spreader and grader system.

* * * * *